US012607172B2

(12) United States Patent
Takemoto et al.

(10) Patent No.: US 12,607,172 B2
(45) Date of Patent: Apr. 21, 2026

(54) FLUID WORKING MACHINE

(71) Applicant: ISUZU MOTORS LIMITED, Yokohama (JP)

(72) Inventors: Shoichi Takemoto, Fujisawa (JP); Koji Terashima, Fujisawa (JP); Yasushi Yamamoto, Fujisawa (JP); Yusuke Kitamoto, Fujisawa (JP)

(73) Assignee: ISUZU MOTORS LIMITED, Yokohama (JP)

( * ) Notice: Subject to any disclaimer, the term of this patent is extended or adjusted under 35 U.S.C. 154(b) by 29 days.

(21) Appl. No.: 18/795,476

(22) Filed: Aug. 6, 2024

(65) Prior Publication Data

US 2025/0075688 A1 Mar. 6, 2025

(30) Foreign Application Priority Data

Sep. 1, 2023 (JP) ..... 2023-142180

(51) Int. Cl.
*F04B 1/0408* (2020.01)

(52) U.S. Cl.
CPC ..... *F04B 1/0408* (2013.01)

(58) Field of Classification Search
CPC .. Y10T 74/2107; F04B 1/0408; F04B 1/0426; F04B 1/04–0439; F04B 53/18; F04B 9/042–045; F03C 1/0406; F03C 1/0419
See application file for complete search history.

(56) References Cited

U.S. PATENT DOCUMENTS 3,967,540 A 7/1976 Eickmann
2015/0308419 A1* 10/2015 Lavender ..... F01B 1/0658 92/72

FOREIGN PATENT DOCUMENTS

CN 113389700 A * 9/2021 ..... F04B 53/18
JP S48-074602 A 10/1973
JP S48-088504 A 11/1973
JP 2011-099350 A 5/2011
JP 2015504124 A * 2/2015 ..... F03D 15/00
JP 2017-002840 A 1/2017
JP 2025053952 A * 4/2025

* cited by examiner

*Primary Examiner* — Thomas Fink
(74) *Attorney, Agent, or Firm* — PROCOPIO, CORY, HARGREAVES & SAVITCH LLP

(57) ABSTRACT

A fluid working machine includes a cylinder that has a housing portion for accommodating a fluid, a piston that reciprocates in the cylinder, and a crankshaft that performs rotational motion in conjunction with reciprocating motion of the piston. The piston has an opposing concave portion provided in an opposing portion that faces a sliding surface of the crankshaft, and to which the fluid is supplied from the housing portion via the communication path. The opposing concave portion is provided in the opposing portion such that the center of gravity position of a force acting on the piston from the fluid in the opposing concave portion is located upstream of the crankshaft in the rotation direction when viewed from a central axis of the piston.

10 Claims, 6 Drawing Sheets

FLUID WORKING MACHINE

CROSS-REFERENCE TO RELATED APPLICATIONS

The present application claims priority to Japanese Patent Applications number 2023-142180, filed on Sep. 1, 2023 contents of which are incorporated herein by reference in their entirety.

BACKGROUND OF THE INVENTION

The present disclosure relates to a fluid working machine that performs energy conversion between fluid and a machine. Japanese Unexamined Patent Application Publication No. 2011-99350 discloses a radial pump motor that supplies fluid (oil) to a sliding surface via a through-passage that passes through a piston that reciprocates in a cylinder disposed around a rotation axle.

The oil entrained by the sliding surface of the rotation axle normally enters between the piston and the rotation axle (referred to as "dynamic pressure effect"). However, when the rotation axle rotates at high speed, there are cases where some of the oil entrained by the sliding surface does not enter between the piston and the rotation axle and pushes the piston from the side. In this case, the piston might tilt relative to the cylinder, which could cause the piston to come into contact with the rotation axle.

BRIEF SUMMARY OF THE INVENTION

The present disclosure focuses on this point, and its object is to prevent inclination of a piston when a rotation axle is rotated.

According to one aspect of the present disclosure, there is provided a fluid working machine including: a cylinder that has a housing portion for accommodating a fluid; a piston that reciprocates in the cylinder due to pressure of the fluid; and a rotation axle that performs rotational motion in conjunction with reciprocating motion of the piston, wherein a plurality of the cylinders and the pistons are disposed in a circumferential direction of the rotation axle in the fluid working machine, the piston includes: a communication path that communicates with the housing portion; and an opposing concave portion provided in an opposing portion that faces a sliding surface of the rotation axle, and to which the fluid is supplied from the housing portion via the communication path, and the opposing concave portion is provided in the opposing portion such that a center of gravity position of a force acting on the piston from the fluid in the opposing concave portion is located upstream of the rotation axle in a rotation direction when viewed from a central axis of the piston.

DETAILED DESCRIPTION OF THE INVENTION

Hereinafter, the present disclosure will be described through exemplary embodiments, but the following exemplary embodiments do not limit the invention according to the claims, and not all of the combinations of features described in the exemplary embodiments are necessarily essential to the solution means of the invention.

<Configuration of a Fluid Working Machine>

A configuration of a fluid working machine according to one embodiment will be described. In the following description, a hydraulic pump motor is described as an example of the fluid working machine, but the fluid working machine is not limited to the hydraulic pump motor. The fluid working machine, also called a fluid machine, is generally a device that converts energy between fluid and machine. Liquids such as water and oil, and gases such as air and gas, are used as fluids. The application varies for low-speed rotation, high-speed rotation, and the like depending on the properties of the fluid, such as density and viscosity.

Figure 1:
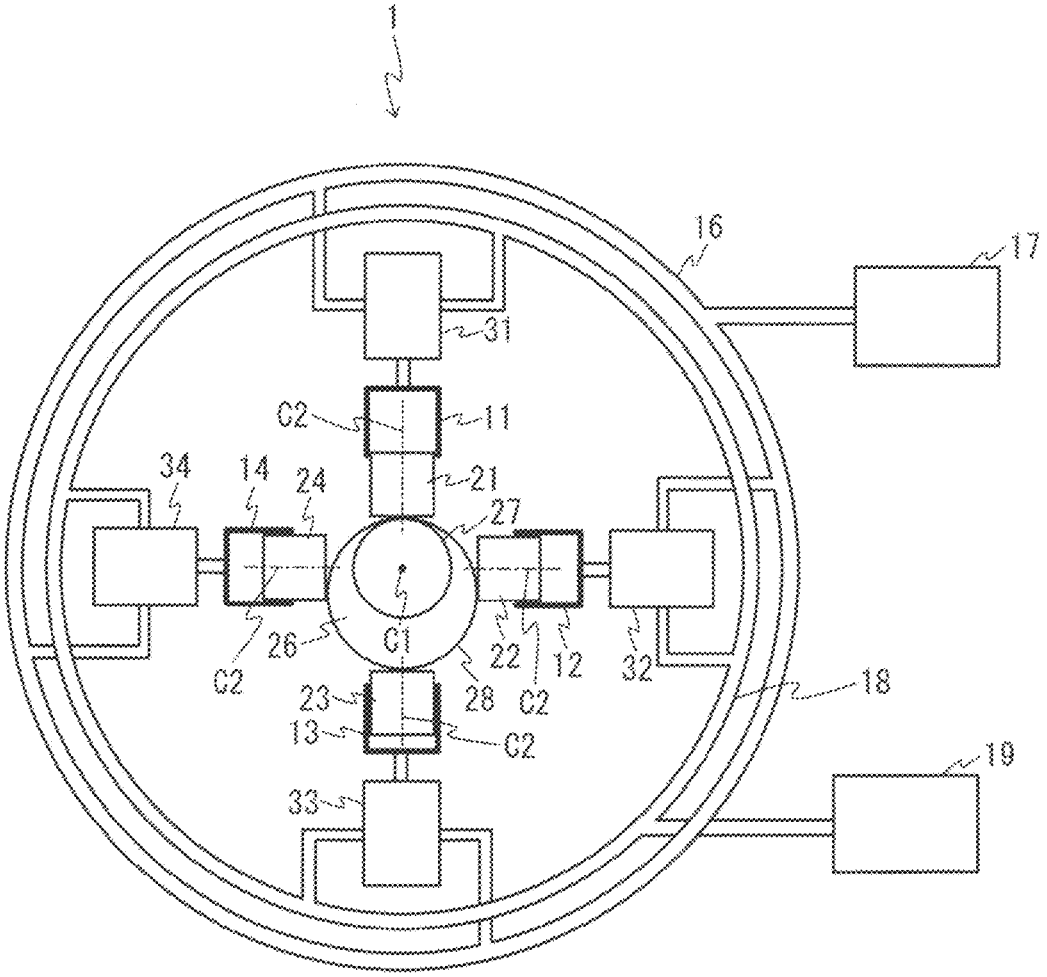
FIG. 1 is a schematic diagram illustrating a configuration of a fluid working machine 1 according to one embodiment.

FIG. 1 is a schematic diagram illustrating a configuration of a fluid working machine 1 according to one embodiment. Here, the fluid working machine 1 is mounted on a vehicle such as a truck. The fluid working machine 1 transmits generated power to drive wheels of the vehicle, for example.

The fluid working machine 1 includes cylinders 11, 12, 13, and 14, a first supply path 16, a second supply path 18, pistons 21, 22, 23, and 24, a crankshaft 26, and valve units 31, 32, 33, and 34. Although four cylinders and four pistons are provided, the number of cylinders and pistons are not limited thereto, and may be three or five or more.

The cylinders 11 to 14 are disposed in the circumferential direction of the crankshaft 26. The cylinders 11 to 14 are disposed counterclockwise at equal intervals (specifically, at intervals of 90 degrees) along the circumferential direction.

The first supply path 16 is a flow path that connects the cylinders 11 to 14 to a first chamber 17 that stores a high-pressure fluid. The first supply path 16 is branched such that the fluid can be supplied to the cylinders 11 to 14. The second supply path 18 is a flow path that connects the cylinders 11 to 14 to a second chamber 19 that stores a low-pressure fluid. The second supply path 18 is also branched such that the fluid can be supplied to the cylinders 11 to 14.

The pistons 21 to 24 are disposed in the circumferential direction of the crankshaft 26, and reciprocate inside the cylinders 11 to 14. The pistons 21 to 24 reciprocate due to the pressure of the fluid supplied to the cylinders 11 to 14. By having the pistons 21 to 24 reciprocate, the crankshaft 26, which is in contact with the pistons 21 to 24, rotates.

The crankshaft 26 is a rotation axle that performs rotational motion in conjunction with reciprocating motion of the pistons 21 to 24. The crankshaft 26 includes a shaft part 27 and a cam part 28. The shaft part 27 is a shaft portion of the crankshaft 26. The rotation center C1 of the shaft part 27 is at a position where central axes C2 of the pistons 21 to 24 intersect. The cam part 28 is provided eccentrically to the outer circumference of the shaft part 27. The pistons 21 to 24 are in contact with an outer peripheral surface of the cam part 28. With this configuration, the reciprocating motion of the pistons 21 to 24 is converted into rotational motion of the shaft part 27 via the cam part 28.

The valve units 31 to 34 adjust a flow of the high-pressure fluid in the first chamber 17 and the low-pressure fluid in the second chamber 19 to the cylinders 11 to 14. Each of the valve units 31 to 34 adjusts the flow of fluid to the corresponding cylinders 11 to 14. For example, the valve unit 31 adjusts the flow of fluid into the cylinder 11.

In the above description, the crankshaft 26 rotates by having the pistons 21 to 24 reciprocated due to the pressure of the fluid supplied to the cylinders 11 to 14. However, the present disclosure is not limited thereto. For example, the crankshaft 26 coupled to a transmission of the vehicle may rotate, and its rotation may cause the pistons 21 to 24 to reciprocate, thereby supplying the fluid in the cylinders 11 to 14 to the first chamber 17 or the second chamber 19.

<Detailed Configurations of a Cylinder and a Piston>

A configuration of each of the cylinders 11 to 14 is the same, and a configuration of each of the pistons 21 to 24 is the same. Hereinafter, the cylinder 11 and the piston 21 will be used as examples and detailed configurations of the cylinder 11 and the piston 21 will be described.

Figure 2:
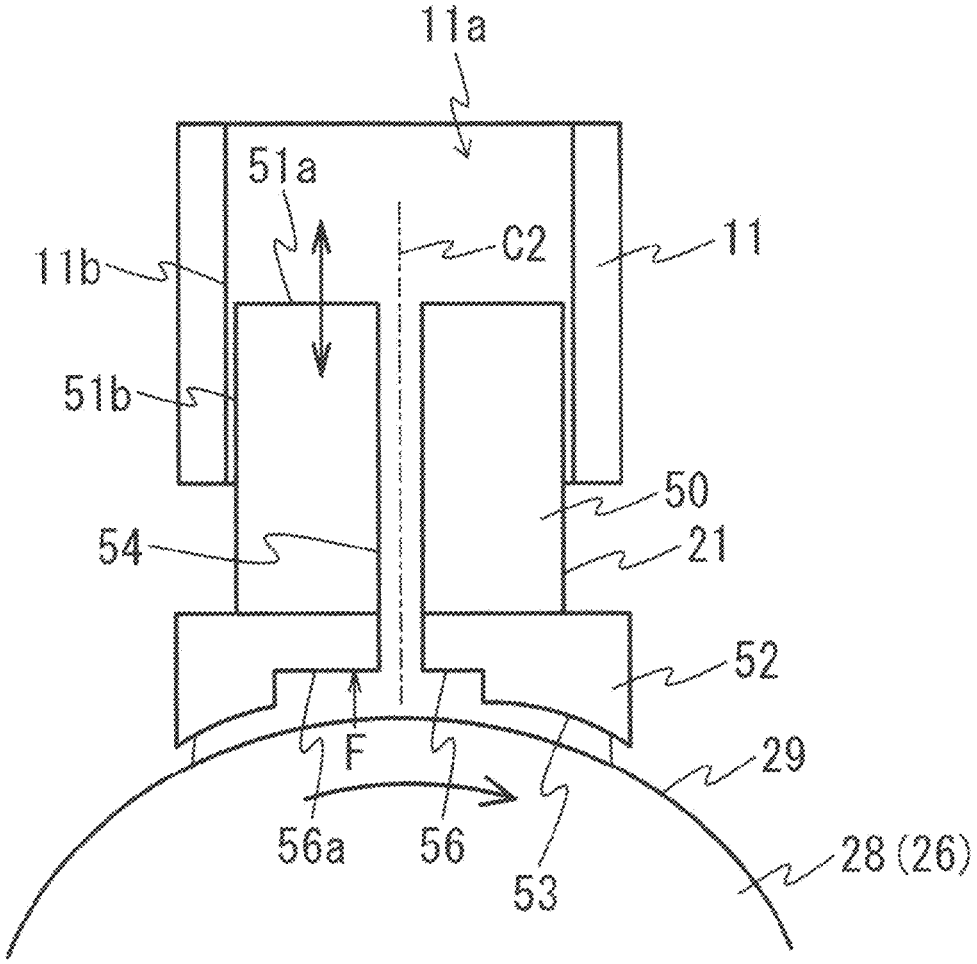
FIG. 2 is a schematic view showing internal configurations of a cylinder 11 and a piston 21.

FIG. 2 is a schematic view showing internal configurations of the cylinder 11 and the piston 21. The cylinder 11 includes a housing portion 11*a* that accommodates fluid. As described above, the fluid is supplied to the housing portion 11*a* via the valve unit 31. The fluid in the housing portion 11*a* exerts pressure on an upper surface of the piston 21 (specifically, an upper surface 51*a* of a main body part 50 of the piston 21). Here, the fluid accommodated in the housing portion 11*a* is oil.

The piston 21 reciprocates in the cylinder 11 due to the pressure of the fluid in the housing portion 11*a*. Here, the piston 21 reciprocates in the direction of an arrow shown in FIG. 2 by receiving the pressure from the fluid. The piston 21 includes the main body part 50, an opposing portion 52, a communication path 54, and an opposing concave portion 56.

The main body part 50 is formed with a columnar shape. The upper surface 51*a* of the main body part 50 is located in the housing portion 11*a* of the cylinder 11. The upper surface 51*a* receives the pressure from the fluid in the housing portion 11*a*. By receiving the pressure from the fluid, the upper surface 51*a* causes the piston 21 to move downward in FIG. 2. A gap is formed between an outer peripheral surface 51*b* of the main body part 50 and an inner wall surface 11*b* of the cylinder 11.

The opposing portion 52 is an opposing portion that faces a sliding surface 29 of the cam part 28 of the crankshaft 26. The opposing portion 52 is a lower portion of the piston 21 and is integrated with the main body part 50. Here, the opposing portion 52, unlike the columnar main body part 50 which is columnar, has a rectangular parallelepiped shape. An opposing surface 53, which is the lower surface of the opposing portion 52, is a curved surface so as to be parallel to the sliding surface 29 of the cam part 28.

The communication path 54 is a flow path provided in the piston 21 and communicates with the housing portion 11*a* of the cylinder 11. The communication path 54 is provided such that it passes through the piston 21 along the central axis C2. Specifically, the communication path 54 is provided such that it passes through the centers of the main body part 50 and the opposing portion 52.

The opposing concave portion 56 is provided on the central part of the opposing surface 53 of the opposing portion 52. The opposing concave portion 56 communicates with the communication path 54. The fluid is supplied to the opposing concave portion 56 from the housing portion 11*a* via the communication path 54. Since the pressure of the fluid in the housing portion 11*a* is higher than the pressure of the fluid in the opposing concave portion 56, the fluid in the housing portion 11*a* is supplied to the opposing concave portion 56. Specifically, while the high-pressure fluid is supplied to the housing portion 11*a* from a first chamber 17 (FIG. 1), the fluid in the housing portion 11*a* is supplied to the opposing concave portion 56. The oil, which is the fluid supplied to the opposing concave portion 56, forms an oil film on the sliding surface 29, thereby reducing friction between the piston 21 and the cam part 28. That is, the oil supplied to the opposing concave portion 56 functions as lubricating oil between the piston 21 and the cam part 28.

A force (hereinafter referred to as a reaction force) from the oil existing between the opposing concave portion 56 and the sliding surface 29 uniformly acts on the entire bottom surface 56*a* of the opposing concave portion 56. By receiving said reaction force, the piston 21 moves upward in FIG. 2. Therefore, the piston 21 reciprocates with respect to the cylinder 11 due to said reaction force and the pressure from the fluid in the housing portion 11*a*.

The opposing concave portion 56 is not disposed symmetrically with respect to the central axis C2 of the piston 21. Specifically, the opposing concave portion 56 is formed on the opposing surface 53 such that a center of gravity position of the reaction force acting on the entire bottom surface 56*a* (the center of gravity position can be referred to as the center position of the total reaction force acting on the bottom surface 56*a*) is located upstream of the crankshaft 26 in a rotation direction when viewed from the central axis C2 of the piston 21 (in FIG. 2, the center of gravity position is located to the left of the central axis C2.) In FIG. 2, the reaction force acting on the center of gravity position is indicated as a reaction force F. In FIG. 2, for convenience of explanation, reaction forces acting on positions other than the center of gravity position of the bottom surface 56*a* are not shown.

Figure 3:
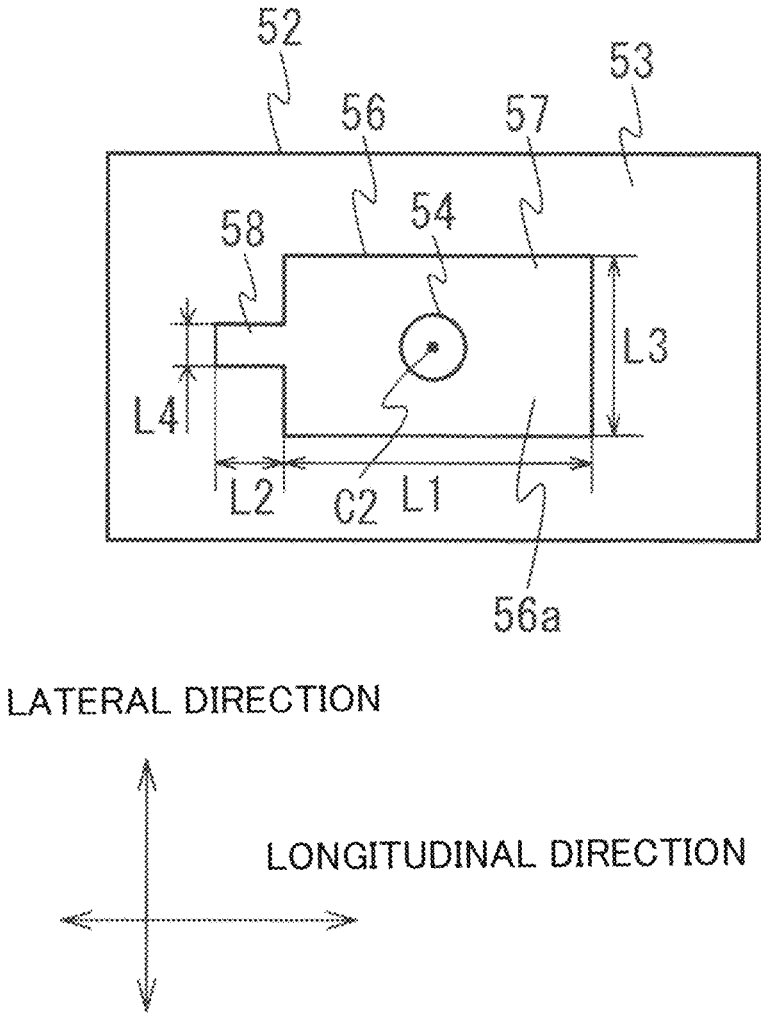
FIG. 3 is a schematic view showing an opposing concave portion 56 of the piston 21.

Hereinafter, a specific configuration of the opposing concave portion 56 will be described with reference to FIG. 3. FIG. 3 is a schematic view showing the opposing concave portion 56 of the piston 21, and is a view of the opposing surface 53 viewed from the sliding surface 29. As shown in FIG. 3, the opposing concave portion 56 has a first concave portion 57 and a second concave portion 58.

The first concave portion 57 is formed to be recessed from the opposing surface 53 by a predetermined depth. The first concave portion 57 communicates with the communication path 54 at the bottom surface 56*a*. The first concave portion 57 is formed at a position through which the central axis C2 of the piston 21 passes. The first concave portion 57 is provided such that the center of the bottom surface 56*a* coincides with the center of the communication path 54 (i.e., the central axis C2.) Therefore, a central portion of the bottom surface of the first concave portion 57 communicates with the communication path 54.

The planar shape of the first concave portion 57 is rectangular, as shown in FIG. 3. The first concave portion 57 is formed to be larger than the communication path 54. A width L1 in the longitudinal direction and a width L3 in the lateral direction along the rotation direction of the first concave portion 57 are larger than the width (in other words, the diameter) in the longitudinal direction of the communication path 54.

The second concave portion 58 is located upstream in the rotation direction (at one end in the longitudinal direction shown in FIG. 3) of the communication path 54. The second concave portion 58 is connected to the first concave portion 57 at one end in the longitudinal direction. The bottom surface of the second concave portion 58 and the bottom surface of the first concave portion 57 form the bottom surface 56*a* described above. In other words, the position of the bottom surface of the second concave portion 58 is the same as the position of the bottom surface of the first concave portion 57 in an axial direction of the piston 21 (see FIG. 2). Since the second concave portion 58 is connected to the first concave portion 57, the opposing concave portion 56 does not have a symmetrical shape with respect to the central axis C2 of the piston 21, and the center of gravity position of the reaction force acting on the opposing concave portion 56 also deviates from the central axis C2 of the piston 21 (see FIG. 2).

The planar shape of the second concave portion 58 is rectangular, in the same manner as the first concave portion 57. As shown in FIG. 3, the second concave portion 58 is connected to the first concave portion 57 at the center of the first concave portion 57 in the lateral direction. Specifically, the second concave portion 58 is located at the same position as the communication path 54 in the lateral direction. In this manner, the reaction force acting on the opposing concave portion 56 is centered in the lateral direction, stabilizing the behavior of the piston 21 during movement.

The size of the second concave portion 58 is smaller than that of the first concave portion 57. Specifically, a width L2 of the second concave portion 58 in the longitudinal direction (direction along the rotation direction) is smaller than the width L1 of the first concave portion 57 in the longitudinal direction. More specifically, the width L2 of the second concave portion 58 in the longitudinal direction is smaller than half the width L1 of the first concave portion 57 in the longitudinal direction. Further, a width L4 of the second concave portion 58 in the lateral direction is smaller than the width L3 of the first concave portion 57 in the lateral direction. More specifically, the width L4 of the second concave portion 58 in the lateral direction is smaller than half the width L3 of the first concave portion 57 in the lateral direction. By adjusting the width L2 in the longitudinal direction of the second concave portion 58 having the above-described shape, the center of gravity position of the reaction force acting on the opposing concave portion 56 can be easily adjusted without changing the shape of the first concave portion 57.

Since the center of gravity position of the reaction force acting on the opposing concave portion 56 is offset upstream in the rotation direction from the central axis of the piston 21, it is possible to prevent the piston 21 from coming into contact with the sliding surface 29 of the crankshaft 26 when the crankshaft 26 rotates. Hereinafter, the present embodiment will be described in detail with reference to a comparative example shown in FIGS. 4A and 4B.

Figure 4A:
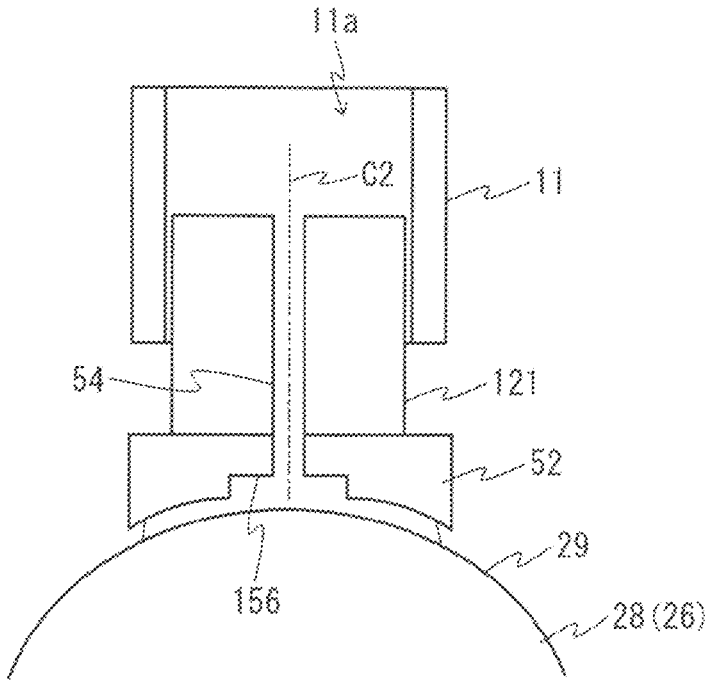
FIG. 4A is a schematic diagram illustrating a configuration of a piston 121 according to a comparative example.
Figure 4B:
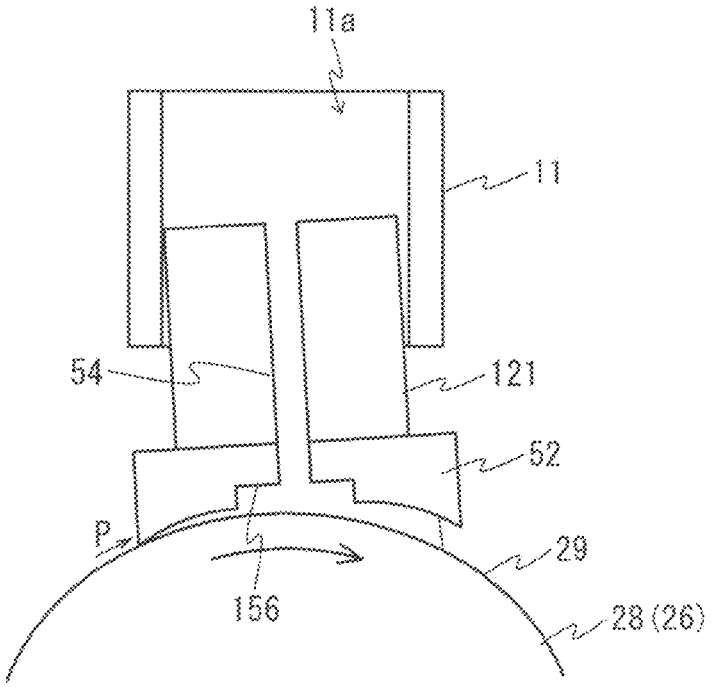
FIG. 4B is a schematic diagram illustrating a configuration of the piston 121 according to the comparative example.

FIGS. 4A and 4B are each a schematic diagram illustrating a configuration of a piston 121 according to the comparative example. An opposing concave portion 156 of the piston 121 of the comparative example is provided symmetrically with respect to a central axis of the piston 121, as shown in FIG. 4A. Therefore, the center of gravity position of a reaction force acting on the opposing concave portion 156 coincides with the center axis of the piston 121. In the piston 121 of the comparative example, since configurations other than the opposing concave portion 156 are the same as that of the piston 21 described above, a detailed description thereof is omitted. Normally, the oil entrained by the sliding surface 29 of the crankshaft 26 enters between the opposing portion 52 and the sliding surface 29 (a dynamic pressure effect). However, in the comparative example, when the crankshaft 26 rotates at high speed, some of the oil entrained by the sliding surface 29 does not enter between the opposing portion 52 of the piston 121 and the sliding surface 29, and pushes a side wall of the opposing portion 52 from the side. In this case, as shown in FIG. 4B, the piston 121 is inclined with respect to the cylinder 11 due to a force (force P shown in FIG. 4B) pushing against the side wall of the opposing portion 52 from the side. Consequently, the inclined piston 121 comes into contact with the sliding surface 29 of the crankshaft 26, causing wear on the piston 121 and the sliding surface 29.

In contrast, in the present embodiment, the opposing concave portion 56 is formed such that the center of gravity position of the reaction force acting on the piston 21 from the oil in the opposing concave portion 56 is located upstream of the crankshaft 26 in the rotation direction when viewed from the central axis of the piston 21. In this case, since the reaction force is more likely to act on the upstream side of the central axis C2 of the piston 21 in the rotation direction, the upstream side of the piston 21 in the rotation direction is more likely to be lifted due to the reaction force (that is, the piston 21 is slightly inclined with respect to the cylinder 11). As a result, even when the crankshaft 26 rotates at high speed, the oil entrained by the sliding surface 29 easily enters between the opposing portion 52 of the piston 21 and the sliding surface 29, and therefore the opposing portion 52 can be prevented from being pushed from the side. As a result, since the inclination of the piston 21 is suppressed, it is possible to suppress the contact of the piston 21 with the sliding surface 29.

Modified Example

Figure 5:
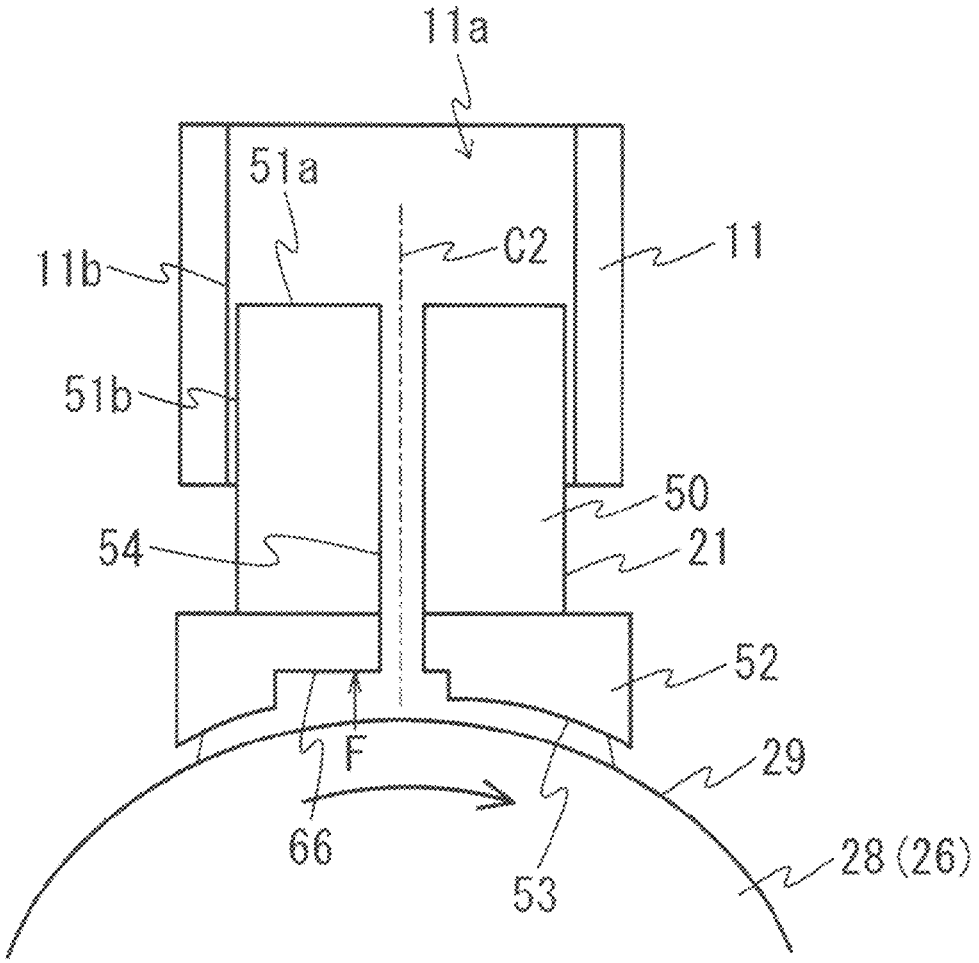
FIG. 5 is a schematic diagram illustrating an internal configuration of a piston 21 according to a Modified Example.
Figure 6:
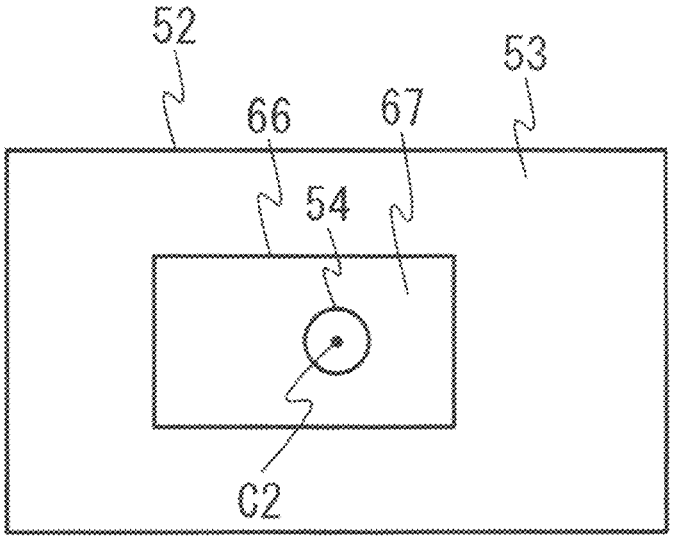
FIG. 6 is a schematic view showing an opposing concave portion 66 according to the Modified Example.

FIG. 5 is a schematic diagram illustrating an internal configuration of a piston 21 according to a Modified Example. FIG. 6 is a schematic view showing an opposing concave portion 66 according to the Modified Example.

The opposing concave portion 56 of the piston 21 has the first concave portion 57 and the second concave portion 58 (see FIG. 3). On the other hand, the opposing concave portion 66 of the piston 21 according to the Modified Example is one concave portion 67 having a rectangular planar shape, as shown in FIG. 6. Here, the concave portion 67 has the same configuration as the first concave portion 57 of the opposing concave portion 56 described above. Specifically, the planar shape of the concave portion 67 is rectangular.

On the other hand, the center position of the concave portion 67 is different from the center position of the first concave portion 57. The center position of the concave portion 67 is located upstream of the crankshaft in the rotation direction when viewed from the central axis C2 of the piston 21. That is, the center position of the concave portion 67 is displaced from the center of the communication path 54. Therefore, the center position of the opposing concave portion 66 is displaced from the center of the communication path 54.

Also in the Modified Example, a center of gravity position of a force acting on the piston 21 from fluid in the opposing concave portion 66 (the position where the reaction force F acts in FIG. 5) is located upstream of the crankshaft 26 in the rotation direction when viewed from the central axis C2 of the piston 21. Therefore, since the reaction force is more likely to act on the upstream side of the central axis C2 of the piston 21 in the rotation direction, the upstream side of the piston 21 in the rotation direction is more likely to be lifted due to the reaction force. As a result, the piston 21 is prevented from being inclined since the oil entrained by the sliding surface 29 easily enters between the opposing portion 52 of the piston 21 and the sliding surface 29, thereby preventing the opposing portion 52 from being pushed from the side.

In the above description, the concave portion 67 has the same shape as the first concave portion 57, but it is not limited thereto. For example, the width of the concave portion 67 in the longitudinal direction may be larger than the width of the first concave portion 57 in the longitudinal direction. In this case, the width of the concave portion 67 in the lateral direction may be smaller than the width of the first concave portion 57 in the lateral direction.

Effect of the Present Embodiment

The piston 21 of the fluid working machine 1 of the above-described embodiment has the communication path 54 communicating with the housing portion 11*a*, and the opposing concave portion 56 provided in the opposing portion 52 and facing the sliding surface 29 of the crankshaft 26. The fluid (oil) is supplied to the opposing concave portion 56 from the housing portion 11*a* via the communication path 54. The opposing concave portion 56 is provided in the opposing portion 52 such that the center of gravity position of the reaction force acting on the bottom surface 56*a* of the opposing concave portion 56 from the oil in the opposing concave portion 56 is located upstream of the rotation axle in the rotation direction when viewed from the central axis of the piston 21. In the case of the above configuration, since the reaction force is more likely to act on the upstream side of the central axis C2 of the piston 21 in the rotation direction, the upstream side of the piston 21 in the rotation direction is more likely to be lifted due to the reaction force. As a result, even when the crankshaft 26 rotates at high speed, the oil entrained by the sliding surface 29 easily enters between the opposing portion 52 of the piston 21 and the sliding surface 29, and therefore the opposing portion 52 can be prevented from being pushed from the side. As a result, since the inclination of the piston 21 is suppressed, it is possible to suppress the contact of the piston 21 with the sliding surface 29.

The present disclosure is explained on the basis of the exemplary embodiments. The technical scope of the present disclosure is not limited to the scope explained in the above embodiments and it is possible to make various changes and modifications within the scope of the disclosure. For example, all or part the apparatus can be configured with any unit which is functionally or physically dispersed or integrated. Further, new exemplary embodiments generated by arbitrary combinations of them are included in the exemplary embodiments of the present disclosure. Further, effects of the new exemplary embodiments brought by the combinations also have the effects of the original exemplary embodiments.

What is claimed is:

1. A fluid working machine comprising:

cylinders that have a housing portion for accommodating a fluid;

pistons that reciprocate in the cylinders due to pressure of the fluid; and a rotation axle that performs rotational motion in conjunction with reciprocating motion of the pistons, wherein the cylinders and the pistons are disposed circumferentially around of the rotation axle in the fluid working machine, the pistons comprise:

a communication path that communicates with the housing portion; and an opposing concave recess provided in an opposing portion of the piston that faces a sliding surface of the rotation axle, and to which the fluid is supplied from the housing portion via the communication path, and the opposing concave recess is provided in the opposing portion such that a center position of a total force acting on the opposing portion of the piston from the fluid in the opposing concave recess is maintained at a position offset from a central axis of the piston in a direction opposite to rotation direction during the reciprocation of the pistons to prevent inclination of the pistons when a rotation axle is rotated.

2. The fluid working machine according to claim 1, wherein the opposing concave recess includes:

a first concave portion, having a rectangular shape, through which the central axis passes, and a second concave portion smaller than the first concave portion and connected to the first concave portion on an upstream side in the rotation direction.

3. The fluid working machine according to claim 2, wherein a width of the first concave portion in the rotation direction is larger than a width of the second concave portion in the rotation direction.

4. The fluid working machine according to claim 2, wherein the second concave portion is connected to the first concave portion at a center of the first concave portion in a lateral direction.

5. The fluid working machine according to claim 4, wherein a width of the second concave portion in the lateral direction is smaller than a width of the first concave portion in the lateral direction.

6. The fluid working machine according to claim 2, wherein the communication path is provided such that the communication path passes through the piston along the central axis, and the second concave portion is located upstream of the communication path in the rotational direction.

7. The fluid working machine according to claim 6, wherein a width of the first concave portion in a longitudinal direction along the rotation direction is larger than a width of the communication path in the longitudinal direction.

8. The fluid working machine according to claim 2, wherein a center of a bottom surface of the first concave portion coincides with a center of the communication path.

9. The fluid working machine according to claim 2, wherein a position of a bottom surface of the second concave portion is the same as a position of a bottom surface of the first concave portion in an axial direction of the piston.

10. The fluid working machine according to claim 1, wherein the opposing concave recess is one concave portion, and a center position of the one concave portion is located offset from a central axis of the piston.

* * * * *